United States Patent [19]

Unterstein

[11] Patent Number: 4,726,544

[45] Date of Patent: Feb. 23, 1988

[54] PROJECTILE STEERING BLOCK

[75] Inventor: Klaus Unterstein, Düsseldorf, Fed. Rep. of Germany

[73] Assignee: Rheinmetall GmbH, Düesseldorf, Fed. Rep. of Germany

[21] Appl. No.: 904,450

[22] Filed: Sep. 5, 1986

[30] Foreign Application Priority Data

Sep. 5, 1985 [DE] Fed. Rep. of Germany ..... 3531686

[51] Int. Cl.[4] ..... F42B 15/033

[52] U.S. Cl. ..... 244/3.22

[58] Field of Search ..... 244/3.22, 169

[56] References Cited

U.S. PATENT DOCUMENTS

| | | | |
|---|---|---|---|
| 3,139,725 | 7/1964 | Webb | 60/35.54 |
| 3,807,660 | 4/1974 | LeCorviger et al. | 244/3.22 |
| 4,541,592 | 9/1985 | Moll | 244/3.22 |

FOREIGN PATENT DOCUMENTS

| | | |
|---|---|---|
| 0060726 | 3/1982 | European Pat. Off. . |
| 2509037 | 7/1982 | France . |
| 892246 | 7/1960 | United Kingdom . |

OTHER PUBLICATIONS

Baumgart; Krupp Technical Communication, No. 1, 1976.

Mueller; "Natural Sciences", 1984, pp. 507, 512, & 514.

Schetky; "Spectrum of Nature" 1980; pp. 48, 49, & 57.

Innovative Technology International, Inc. publication.

*Primary Examiner*—Charles T. Jordan

[57] ABSTRACT

A steering block for the final phase of a guided projectile comprises control jets acted upon by hot gas created in a combustion chamber. A preferred embodiment of more compact and acceleration resistant construction, uses four control jets arranged lying in the cross sectional plane of the projectile casing equidistantly distributed around the circumference of the projectile casing. Each control jet has a corresponding valve likewise arranged lying in a plane in such a way that their longitudinal axes extend along chords of the circular cross section of the projectile casing. In another preferred embodiment, for purposes of further cost reduction in volume and weight, the valves have an adjusting member made of memory alloy which is electrothermically acted upon by way of a heating element.

6 Claims, 2 Drawing Figures

PROJECTILE STEERING BLOCK

BACKGROUND OF THE INVENTION

The invention concerns a steering block for the final phase of a guided projectile fired from a barrel weapon. These projectiles, for the purpose of combating pin point targets over very great distances, must receive a correcting impulse in the final phase of their flight path in order to hit the pin point target. Steering blocks are used for this purpose and must, despite the highest acceleration and temperature requirements, have extremely reliable operation and the smallest possible size, so that they can be housed in projectiles having conventional caliber values of 155 mm or 203 mm.

It is an object of the present invention to provide a steering block which fulfills these requirements.

SUMMARY OF THE INVENTION

The invention concerns a steering block for the final phase of a guided projectile with control jets acted upon by hot gas created in a combustion chamber. For the purpose of more compact and acceleration resistant construction, four control jets are arranged lying in the cross sectional plane of the projectile casing equidistantly distributed around the circumference of the projectile casing. Each control jet has a corresponding valve. The valves are likewise arranged lying in a plane in such a way that their longitudinal axes extend along chords of the circular cross section of the projectile casing. For purposes of further cost reduction in volume and weight, the valves have an adjusting member made of memory alloy which is electrothermically acted upon by way of a heating element.

BRIEF DESCRIPTION OF THE DRAWING

The invention is more easily understood by reference to the accompanying drawing in which.

DESCRIPTION OF THE PREFERRED EMBODIMENTS

Figure 1:
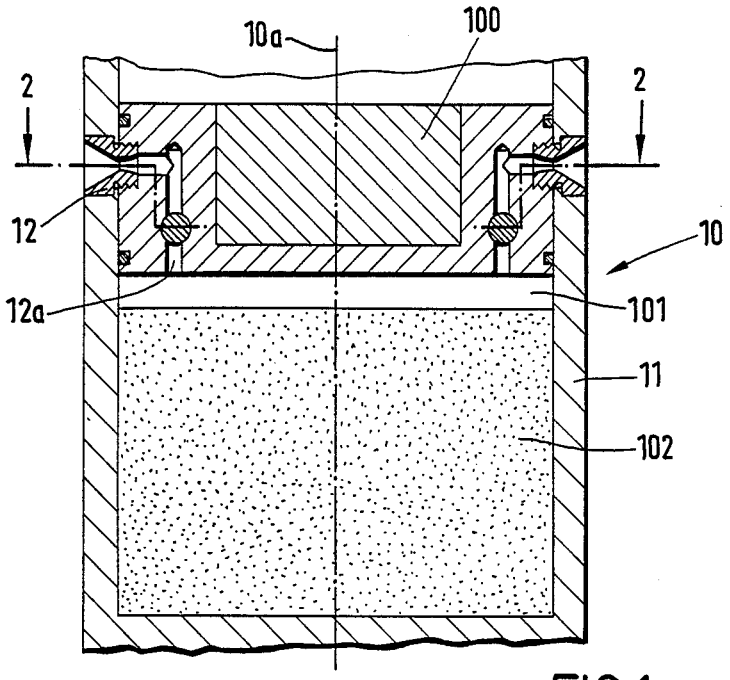
FIG. 1 is a longitudinal cross section through the projectile showing the steering block.
Figure 2:
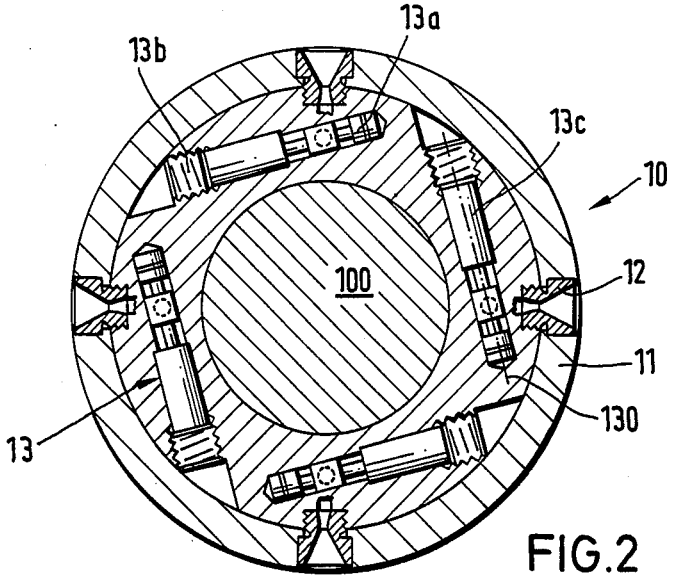
FIG. 2 is a cross section through the projectile according to FIG. 1 along the 2—2 axis.

FIGS. 1 and 2 show a portion of a projectile 10 in the area of the steering block 100. The projectile 10 comprises an essentially hollow cylindrical casing 11 which also encloses the steering block 100. The steering block 100 comprises a hot gas generator with combustion chamber 101 and propellant charge 102, as well as control jets 12 and valve arrangement 13. Through conversion of the propellant charge 102, a heated gas is created in the combustion chamber 101, at temperatures ranging from 1400 to 2000 degrees Kelvin, which acts upon the control jets 12 by way of the valve arrangement 13. The control jets 12 lie in a cross sectional plane of the casing 11, whereby a total of four control jets 12 are arranged equidistant from one another around the circumference of a circle. Each control jet 12 has a corresponding valve arrangement 13, whereby all valves 13 are likewise arranged lying in a cross sectional plane of the casing 11, such that their longitudinal axes 130 are each aligned along a chord of the casing cross section.

In a particularly practical arrangement, the valves 13 lie each on the side of a square within the cross sectional plane. The said arrangement described above results in an extremely flat construction of the steering block which has a very small spatial requirement and, therefore, only requires a very small portion of the payload (useful load) volume of the projectile 10. Moreover, the symmetrical arrangement of the control jets 12 and the valves 13 allows for a very even mass distribution in the region of the steering block 100 in reference to the longitudinal axis 10a of the projectile. This is an advantage when viewed in reference to the possible torsional force impact requirements of the projectile 10. Since the operational direction of the valve arrangement 13 lies along a cross sectional plane which is vertical to the longitudinal axis 10a of the projectile 10, the acceleration forces, especially developing in the longitudinal direction, cannot have a detrimental effect on the opening and/or closing function of the valves 13.

The heated gas created in the combustion chamber 101 reaches the control jets 12 by way of the borings **12*a*, which are acted upon by the valves 13 during opening and closing. Through selective activation of each of the control jets 12, a steering impulse can be exercised in four directions, for the purpose of correcting the flight path, by way of each pair of diametrically opposite control jets 12**.

In an embodiment of particular utility, an adjusting member **13*c* of the valve 13, operated by a piston 13*a* consists of a memory alloy, e.g. NITINOL, available from Innovative Technology International, Inc., Beltsville, MD, USA. Such metals can be activated electrothermally, i.e. by way of addition of heat, the existing martensite grain structure changes to an austenite grain structure in the relatively short time span of approximately 100 ms, and vice versa so that by reduction of heat the process is reversed. During conversion, which is created by the addition of heat by means of a heating element 13*b*, the adjusting member 13*c* performs a stroke, for example, between one and 10 mm, whereby the same can produce a force of up to 300 N. Such adjusting members are distinguished, in comparison to conventional electromagnets of like performance, by their considerably smaller size and weight. Thus, the basic purpose of the invention is also furthered by these properties. Adjusting members of the type named and suited for memory alloys are distributed, for example, by the firm Raychem. The piston 13*a* connected to the adjusting member 13*c* is purposefully manufactured from a material with minimal thermal conductivity, preferably ceramic or silicon nitride, in order to preclude a detrimental effect on the function of the adjusting member 13*c* by the hot gases guided through the borings 12*a* to the control jets 12**.

Although the invention is described and illustrated with reference to a single embodiment thereof, it is to be expressly understood that it is in no way limited to the disclosure of such preferred embodiment but is capable of numerous modifications within the scope of the appended claims.

I claim:

1. A steering block for guiding a projectile during its final phase of flight comprising, in a casing of the projectile, a hot gas generator having a combustion chamber for combustion of a propellant charge, a plurality of control jets, each of said control jets having a corresponding valve operatively connected to it, each of said valves being operatively connected to the hot gas generator, thereby adjusting the flow of hot gas through said control jets, each of said control jets being arranged equidistant from one another and positioned lying in a cross sectional plane of the casing, and each of said corresponding valves likewise lying arranged in a cross sectional plane of said casing such that the longitudinal axis of each said valve is positioned to extend along a chord of the casing cross section.

2. A steering block as claimed in claim 1, wherein said valves are arranged with their longitudinal axes forming the sides of a square.

3. A steering block as claimed in claim 1, each of the valves comprising a piston, an adjusting member made of memory alloy, and a heating element, said piston being acted upon by said adjusting member, and said adjusting member being acted upon electrothermically by said heating element whereby the length of said adjusting member, accordingly the position of said piston, is varied.

4. A steering block as claimed in claim 2, each of the valves comprising a piston, an adjusting member made of memory alloy, and a heating element.

said piston being acted upon by said adjusting member, and said adjusting member being acted upon electrothermically by said heating element whereby the length of said adjusting member, accordingly the position of said piston, is varied.

5. A steering block as claimed in claim 3, said piston being made of ceramic or silicon nitride.

6. A steering block as claimed in claim 4, said piston being made of ceramic or silicon nitride.

* * * * *